US005651166A

United States Patent [19]

Lundstedt

[11] Patent Number: 5,651,166

[45] Date of Patent: Jul. 29, 1997

[54] METHOD AND APPARATUS FOR ANTI-SLIP WEBBING ADJUSTMENT

[75] Inventor: Kurt H. Lundstedt, Hawthorne Woods, Ill.

[73] Assignee: Illinois Tool Works Inc., Glenview, Ill.

[21] Appl. No.: 555,863

[22] Filed: Nov. 13, 1995

[51] Int. Cl.[6] ..... A44B 11/00

[52] U.S. Cl. ..... 24/200; 24/196

[58] Field of Search ..... 24/200, 196, 194, 24/68 CD, 313, 318

[56] References Cited

U.S. PATENT DOCUMENTS

| | | | |
|---|---|---|---|
| 3,163,905 | 1/1965 | Gaylord . | |
| 3,349,449 | 10/1967 | Hatfield . | |
| 3,686,715 | 8/1972 | Brodnicki | 24/68 CD |
| 3,703,024 | 11/1972 | Johnson . | |
| 3,798,711 | 3/1974 | Cousins . | |
| 4,171,555 | 10/1979 | Bakker et al. | 24/200 |
| 4,525,901 | 7/1985 | Krauss | 24/200 |
| 4,577,377 | 3/1986 | Kasai . | |
| 4,610,056 | 9/1986 | Emmert . | |
| 4,754,530 | 7/1988 | Lindblad . | |
| 4,791,709 | 12/1988 | Fildan . | |
| 5,173,539 | 12/1992 | Lundstedt et al. . | |
| 5,243,741 | 9/1993 | Fudaki et al. | 24/200 |
| 5,371,926 | 12/1994 | Van Noy et al. . | |

FOREIGN PATENT DOCUMENTS

| | | | |
|---|---|---|---|
| 0947110 | 1/1964 | United Kingdom | 24/194 |

*Primary Examiner*—Victor N. Sakran
*Attorney, Agent, or Firm*—Schwartz & Weinrieb

[57] ABSTRACT

A method and apparatus for webbing retention and adjustment that includes a body member having opposing side members interconnected by first and second transverse members. A resilient projecting member extends upwardly from a lower portion of the body member and includes a front side portion biased toward the second transverse member and engageable with a portion of the webbing between the second transverse member and the resilient projecting member so as to increase the friction on the webbing and prevent slippage of the webbing in at least one direction with little or no tension on the webbing. The resilient projecting member is flexible away from the second transverse member to at least partially disengage the webbing and ease adjustment of the webbing by reducing the friction on the webbing and reducing the webbing release angle required to adjust the webbing. The body member may be configured as a unitary plastic buckle with a third transverse member interconnecting the opposing side portions wherein a portion of the webbing is looped around the third transverse member and secured to itself by stitching or other means known in the art, or as part of a buckle system with mating male and female portions.

20 Claims, 2 Drawing Sheets

METHOD AND APPARATUS FOR ANTI-SLIP WEBBING ADJUSTMENT

BACKGROUND OF THE INVENTION

The invention generally relates to a method and apparatus for webbing retention and adjustment, and in particular to a method and apparatus for increasing friction on a webbing and preventing slippage of the webbing through a body member, like a buckle, with a resilient projecting member biased to engage the webbing wherein the resilient member is movable away from the webbing to ease adjustment of the webbing.

Buckles are well known for fastening one or more free ends of a belt or other strap, widely known as webbing, in countless applications including passenger and cargo restraints, lifejackets, and outerwear that has resulted in tremendous success in the marketplace. Buckles generally include a frame with several transverse members about which one or more end portions of webbing are secured. Typically, a first end portion of webbing is looped around one of the transverse members and secured to itself by means known in the art, and a second end portion of webbing is adjustably threaded between a combination of two or more transverse members that frictionally engage and prevent slippage of the second end portion of webbing. To improve frictional engagement of the webbing, U.S. Pat. Nos. 3,349,449 and 4,791,709 disclose variations on a sliding transverse bar that moves in guide slots along inner side portions of the frame and is engageable with the webbing wherein increased tension on the webbing tends to increase friction with the slidable transverse member. To ensure engagement of webbing under a lesser amount of tension, U.S. Pat. Nos. 3,163,905 and 5,170,539 disclose variations on a sliding transverse bar that is biased into engagement with the webbing by spring means. A separate transverse bar however has the disadvantage that it tends to bind in the guide slots, which may result in failure of the buckle. Furthermore, separate parts like the slidable transverse bar and spring means require additional manufacture or fabrication steps, must conform with narrow tolerances to ensure reliable operation, and moreover require additional assembly all of which results in increased cost.

Some of the problems discussed above are overcome by U.S. Pat. No. 4,171,555 which discloses, as illustrated in FIG. 5*a* of the present application, a unitary buckle 1 having first and second transverse members 2 and 3 interconnecting opposing sides 4 and 5 to form a body member having an upper side and a lower side. FIG. 5*b* illustrates an end portion of the webbing W extended from the lower side of the buckle upward and over the second transverse member 3, back downward between the first and second transverse members, and then between the webbing and a lower surface 6 of the first transverse member. The first transverse 2 member is positioned relative to the second transverse member 3 to form a path along which the webbing is fed to ensure sufficient friction to prevent slippage of the webbing under a tension T. These buckles however require that a minimum amount of tension be applied to the webbing before the webbing is frictionally engaged and prevented from slipping by the first and second transverse members. The webbing therefore has a tendency to slip through the buckle under little or no tension, which may frustrate efforts to secure the webbing. To decrease webbing slippage, FIG. 5*c* illustrates that the first and second transverse members are configured so that a plane aspect of the buckle is must be oriented at an increased angle relative to the webbing, in comparison to other prior art buckles, before the webbing may be adjusted or loosened between the first and second transverse members. This angle is sometimes referred to as the webbing release angle. Merely increasing the webbing release angle however does not entirely prevent loosening of the webbing, particularly when the webbing is under little or no tension and subject to movement as in the case of an active child loosely restrained by the webbing. In addition, space limitations may impede or prevent orienting the buckle at such an increased webbing release angle, and moreover orienting the buckle at such an increased release angle temporarily increases tension on the webbing, which may cause discomfort and result in injury or damage.

U.S. Pat. No. 4,754,530 overcomes in part some of the disadvantages discussed above with a unitary strap tensioning device having a spring-loaded clamp. The embodiments disclosed however are made from metal which requires fabrication steps including stamping parts from a metal sheet, subsequent bending of the stamped metal part, and coating of the finished part all of which increase costs. In addition, the disclosed embodiments are not readily formed from a plastic material and therefore do not have many of the advantages of a plastic device. For example, the metal is stressed during fabrication which may have an adverse effect on its strength, and metal is limited to application in non-corrosive environments. The disclosed embodiments also include functional structure with protruding appendages that can not readily be formed in a low profile design, which further limits application to environments where entanglement and snagging of the appendages is not a concern or safety factor.

In view of the discussion above, there exists a demonstrated need for an advancement in the webbing retention and adjustment art. It is therefore an object of the present invention to provide a novel method and apparatus for webbing retention and adjustment that overcomes the problems in the prior art.

It is also an object of the invention to provide a novel method and apparatus for anti-slip webbing retention and adjustment that increases friction on the webbing and prevents slippage of the webbing in at least one direction with little or no tension applied to the webbing.

It is another object of the invention to provide a novel method and apparatus for anti-slip webbing retention and adjustment that eases adjustment of the webbing by reducing friction on the webbing and reducing the webbing release angle required to adjust the webbing.

It is a further object of the invention to provide a novel method and apparatus for anti-slip webbing adjustment that is economical to manufacture, reliable, and does not require assembly of separate components.

Accordingly, the present invention is directed toward a method and apparatus for webbing retention and adjustment that includes a body member having opposing side members interconnected by at least first and second transverse members. The body member has an upper side and a lower side wherein a lower side portion of the first transverse member forms a webbing contact surface. A resilient projecting member extends upwardly from a lower portion of the body member and includes a front side portion biased toward the second transverse member and engageable with a portion of the webbing between the resilient projecting member and the second transverse member to prevent slippage of the webbing in at least one direction with little or no tension on the webbing. The resilient projecting member is flexible away from the second transverse member to at least partially disengage the webbing to ease adjustment of the webbing by reducing friction on the webbing and reducing the webbing release angle required to adjust the webbing. In one embodiment, a front side portion of the resilient projecting member includes a ledge portion with a lower surface, a lower front face extending from the ledge portion thereof toward the lower side of the body member, and an upper front face extending from the ledge thereof toward the upper side of the body member wherein at least a portion of the front side portion of the resilient projecting member is engageable with the webbing and at least urges the webbing toward the second transverse member to increase friction on he webbing and prevent slippage of the webbing in at least one direction. In another embodiment, a front side portion of the second transverse member includes a ledge with an upper surface, an upper front face extending from the ledge portion thereof toward the upper side of the body member, and a lower front face extending from the ledge thereof toward the lower side of the body member so that the front side portion of the second transverse member at least partially complements the front side portion of the resilient projecting member. In one embodiment, the webbing is prevented from slipping in a first direction and is adjustable in second direction when the resilient projecting member is positioned toward the second transverse member wherein the resilient flexible member is movable away from the second transverse member to ease adjustment of the webbing in the first and second directions. The body member may be configured as unitary plastic buckle with a third transverse member interconnecting the opposing side portions wherein another webbing portion is looped around the third transverse member and secured to itself by stitching or other means known in the art. In another embodiment, the body member is configured as part of a buckle system with mating male and female portions.

These and other objects, features and advantages of the present invention will become more fully apparent upon consideration of the following Detailed Description of the Invention with the accompanying drawings wherein like structure and steps are referenced by corresponding numerals and indicators.

DETAILED DESCRIPTION OF THE INVENTION

Figure 1:
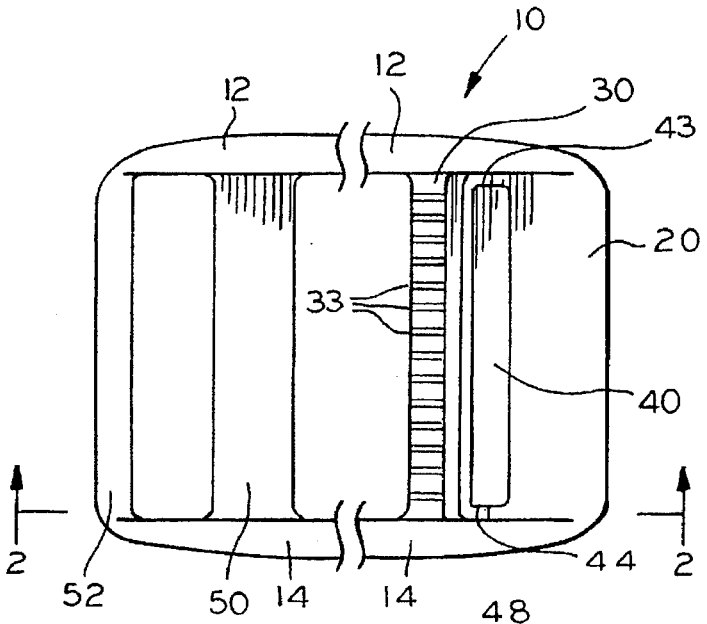
FIG. 1 is a top view of an apparatus for webbing retention and adjustment according to an embodiment of the present invention that includes a resilient projecting member biased toward a second transverse member.
Figure 2:
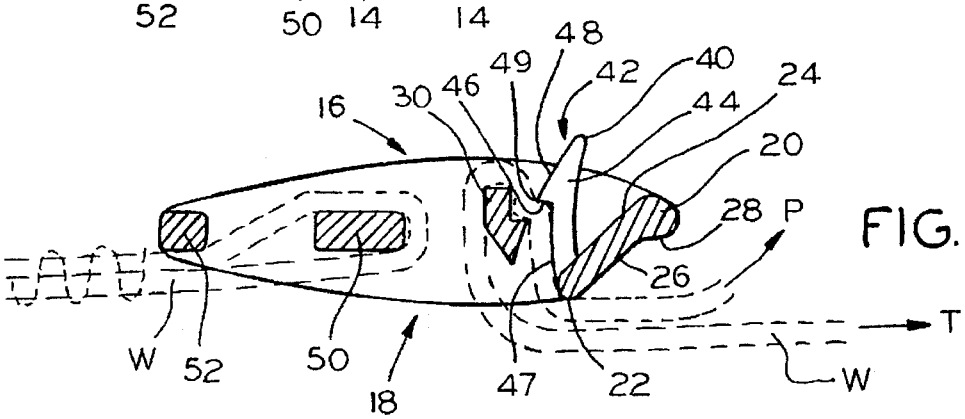
FIG. 2 is a partial sectional view along lines 2—2 of FIG. 1 illustrating the resilient projecting member positioned toward the second transverse member to increase friction on the webbing and prevent slippage of the webbing in at least one direction.
Figure 3:
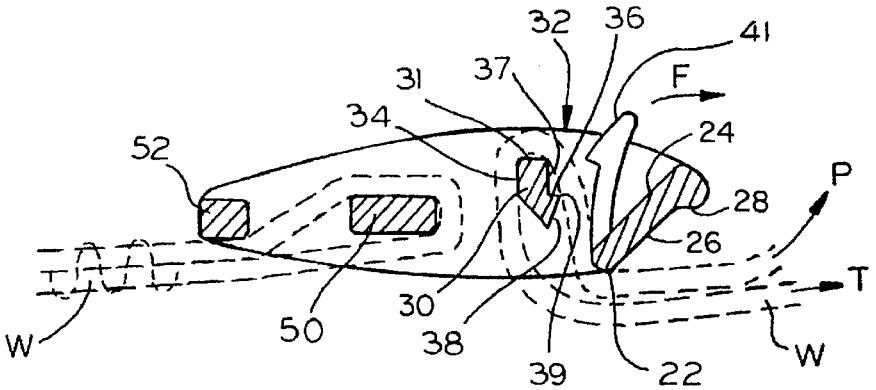
FIG. 3 is a partial sectional view similar to FIG. 2 illustrating the resilient projecting member flexed away from the second transverse member to at least partially disengage the webbing to ease adjustment of the webbing.

FIG. 1 is a top view of an apparatus 10 for webbing retention and adjustment according to one embodiment of the present invention generally comprising a body member having at least two opposing side members 12 and 14 interconnected by a first transverse member 20 and a second transverse 30 member. The first transverse member includes a resilient projecting member 40 biased toward the second transverse member 30 for increasing friction on a webbing to prevent slippage of the webbing in at least one direction, and is manually flexible away from the second transverse member to ease adjustment of the webbing as further discussed below. The resilient projecting member engages the webbing by contacting and urging the webbing at least toward the second transverse member to increase friction on the webbing. The second transverse member cooperates with the resilient projecting member and may also contact and urge the webbing at least toward the resilient projecting member to increase friction on the webbing. FIG. 2 is a partial sectional view along lines 2—2 of FIG. 1 including a first webbing portion W engaged by at least a portion of the resilient projecting member positioned toward the second transverse member to increase friction and prevent slippage of the webbing. The body member has for ease of reference a plane aspect with an upper side 16 and a lower side 18. The first transverse member 20 has a lower side portion that forms a webbing contact surface 22 and an inner side portion 24 that slopes upward from the lower side portion and away from the second transverse member to permit flexing movement of the resilient projecting member 40 over the inner side portion 24 and away from the second transverse body member in the direction of arrow F as illustrated in FIG. 3. The first transverse member 20 includes a front side portion 26 that forms an end portion of the body member including a lip portion 28 to facilitate gripping and orienting the apparatus at a webbing release angle relative to the webbing for adjusting the webbing. The first transverse member 20 may in general be one of several transverse members intermediate the end portion of the body member, and the resilient projecting member may extend from a lower portion of the body member.

In the exemplary embodiment, the resilient projecting member 40 extends upward from a lower portion of the first transverse member 20, and includes a front side portion 42 facing the second transverse member 30. Opposing lateral side portions 43 and 44 of the resilient projecting member are not connected to the opposing sides members 12 and 14 to permit movement of the resilient projecting member 40 toward and away from the second transverse member 30. In one embodiment, a top portion 41 of the resilient projecting member protrudes above the opposing side members to facilitate gripping and flexing the resilient projecting member away from the second transverse member. Increasing the extent that the projecting member protrudes above the opposing side members decreases the force required to flex or move the resilient projecting member. The front side portion 42 of the resilient projecting member is biased toward the second transverse member 30 and includes a surface portion engageable with a portion of the webbing between the resilient projecting member and the second transverse member. The resilient projecting member contacts and urges the webbing toward the second transverse member, and in some embodiments in contact with the second transverse member, to increase friction on the webbing as the webbing loops about the second transverse member 30 and along the lower portion 22 of the first transverse member to prevent slippage of the webbing. The resilient projecting member also prevents slippage of the webbing with little or no tension applied to the webbing. As tension on the webbing is increased in the direction of arrow T, the webbing is more securely engaged by the apparatus when oriented relative to the webbing as in FIG. 2. In one embodiment, the front side portion of the resilient projecting member at least partially complements a surface portion of the second transverse member 30 to form a tortuous path that increases friction on the webbing and prevents slippage of the webbing. One or more barbs or ridges may alternatively or cumulatively be disposed on the front side portion of either or both the resilient projecting member and the second transverse member for further increasing friction on the webbing. In the exemplary embodiment, the front side portion 42 includes a ledge portion having a lower surface 46 facing toward the lower side 18 of the body member, a lower front face 47 extending from the ledge portion toward the lower side 18 of the body member, and a sloping upper front face 48 extending from the ledge toward the upper side 16 of the body member. At least an edge portion 49, formed by an acute angle between the sloping upper front face 48 and a portion of the lower surface 46, engages and urges the webbing at least toward the second transverse member to increase friction on the webbing and prevent slippage of the webbing in the direction indicated by arrow T when the resilient projecting member is positioned toward the second transverse member. The geometry of the front side portion 42 may vary so long as it cooperates with the second transverse member to engage and increase friction on the webbing to prevent slippage of the webbing in at least the direction indicated by arrow T when the resilient projecting member is positioned toward the second transverse member, and to permit at least partial disengagement and decrease of friction on the webbing when the resilient projecting member 40 is flexed away from the second transverse member 30 to ease adjustment of the webbing as discussed below.

The second transverse member includes an upper side portion 31, a front side portion 32 facing the resilient projecting member, and a back side portion 34. In one embodiment, the upper side portion 31 has a contoured upper face to increase the surface area contacting the webbing and a series of striations or grooves 33 to prevent lateral slippage and bunching of the webbing on the second transverse member. Similar grooves, not shown in the drawing, may be disposed on webbing contact surface 22 of the first transverse member discussed above for the same purpose. The upper side portion 31 may also be disposed intermediate the upper and lower sides 16 and 18 of the opposing side members to prevent the webbing from protruding from the body member. The back side portion 34 of the second transverse member includes an upper face that joins the upper side portion 31 and a lower face that joins the front side portion 32. The geometry of the front side portion 32 may vary so long as it cooperates with the resilient projecting member to engage and increase friction on the webbing to prevent slippage of the webbing in at least the direction indicated by arrow T when the resilient projecting member is positioned toward the second transverse member, and permits at least partial disengagement and decrease of friction on the webbing when the resilient projecting member 40 is flexed away from the second transverse member 30 to ease adjustment of the webbing as discussed below. In the exemplary embodiment, the front side portion 32 of the second transverse member includes a ledge portion having an upper surface 36 facing toward the upper side 16 of the body member, an upper front face 37 extending from the ledge portion toward the upper side 16 of the body member, and a sloping lower front face 38 extending from the ledge toward the lower side 18 of the body member. At least an edge portion 39, formed by an acute angle between the sloping lower front face 38, engages and urges a portion of the webbing at least toward the resilient projecting member to increase friction on the webbing and prevent slippage of the webbing in at least the direction of arrow T when the resilient projecting member is positioned toward the second transverse member.

Figure 5A:
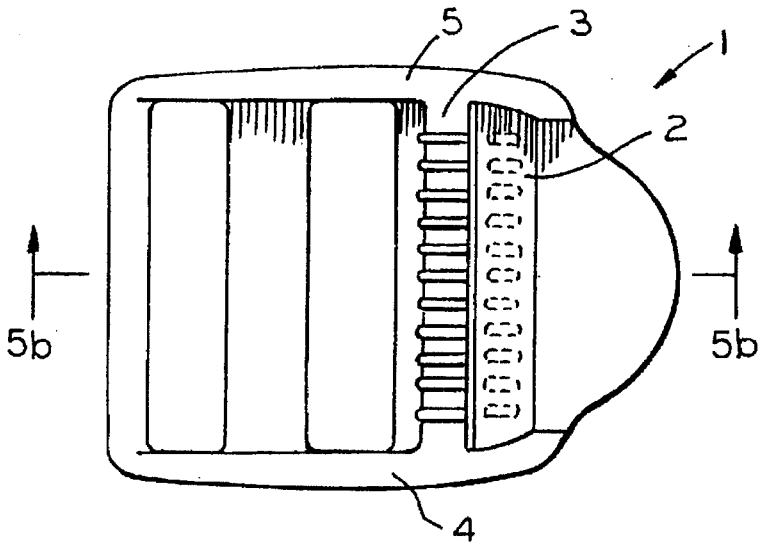
FIG. 5*a* is a prior art buckle.
Figure 5B:
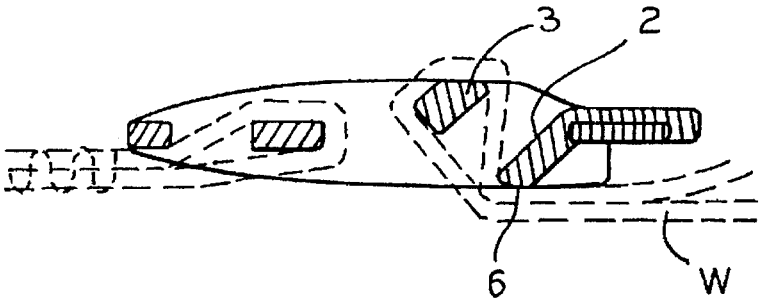
FIG. 5*b* a sectional view of the prior art buckle along lines 2*b*—2*b* of FIG. 5*a* illustrating a webbing under tension engaged and retained by the buckle.
Figure 5C:
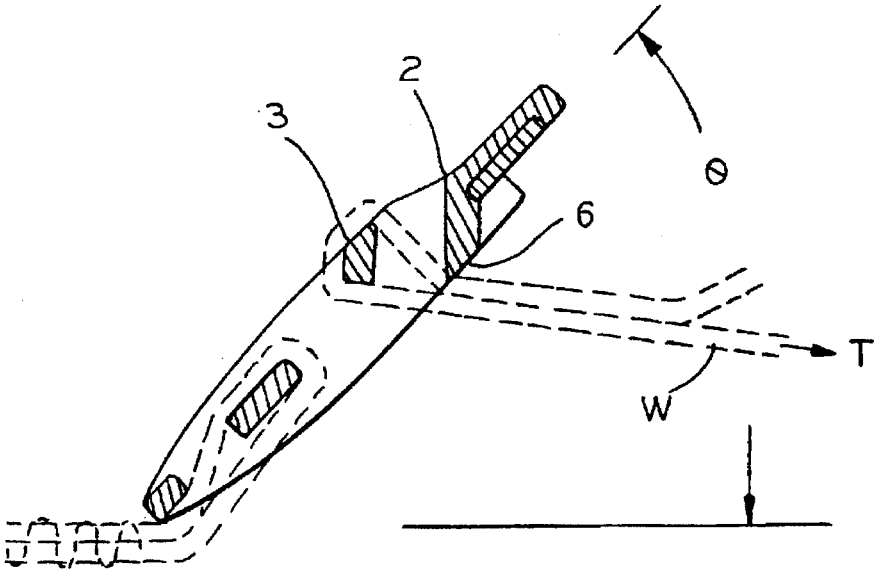
FIG. 5*c* is the buckle of FIG. 5*b* illustrating a plane of the buckle oriented at an increased webbing release angle relative to the webbing to permit adjustment of the tensioned webbing.

FIG. 3 illustrates an end portion of webbing W extended upward from the lower side 18 of the body member, along the back side portion 34 and over the upper side portion 31 of the second transverse member 30. The resilient projecting member 40 is flexed away from the second transverse member 30, in the direction of arrow F, to ease passage of the webbing downward between the second transverse member and the resilient projecting member. The webbing is then extended along the webbing contact surface 22 between the first transverse member 20 and the webbing W in the direction of arrow P. In the exemplary embodiment of FIG. 2, the resilient projecting member 40 is biased toward the second transverse member 30 so that at least a portion of the front side portion 42 of the resilient projecting member contacts and urges a portion of the webbing at least toward the front side portion 32 of the second transverse member 30 to increase friction on the webbing and prevent slippage of the webbing in at least the direction of arrow T. As the resilient projecting member moves toward the second transverse member, a portion of the lower surface 46 of the resilient projecting member applies a downwardly directed force on the webbing toward the upper surface 36 of the second transverse member, the lower face portion 47 of the resilient projecting member applies a lateral force on the webbing toward the sloping lower face portion 38 of the second transverse member, and the sloping upper face portion 48 of the resilient projecting member applies a lateral force on the webbing toward the upper face portion 37 of the second transverse member to increase friction on the webbing and prevent slippage of the webbing. The complementary front side portion of the second transverse member likewise applies corresponding reaction forces on the webbing where the webbing contacts the front side portion of the second transverse member. The resilient projecting member and the second transverse member thereby cooperate to at least partially engage and increase friction on the webbing W to prevent slippage of the webbing in at least the direction of arrow T, although the webbing may be adjusted in the direction of the arrow P without flexing the resilient member 40 away from the second transverse member. Moving the resilient member 40 in the direction of the arrow F eases adjustment of the webbing in the direction of the arrow P by reducing friction on the webbing. The webbing is adjustable in both directions T and P when the resilient projecting member is positioned toward the second transverse member by orienting the plane of the apparatus at an appropriate webbing release angle relative to the webbing, similar to the illustration of FIG. 5*c*. Flexing the resilient projecting member away from the second body member eases adjustment of the webbing in both directions by reducing friction on the webbing and reducing the webbing release angle required to adjust the webbing. The extent to which the resilient projecting member eases webbing adjustment by reducing friction on the webbing, and accordingly reduces the webbing release angle between the apparatus and the webbing, depends on the extent to which the resilient projecting member is movable away from the second transverse member.

In another embodiment, the resilient projecting member and the second transverse member are configured to engage and increase friction on the webbing to prevent slippage of the webbing W in both directions P and T unless the apparatus is oriented at the webbing release angle relative to the webbing. For example, the edge portions 36 and 46 and edge portions 39 and 49 may be extended, or configured with barbs, to engage and urge portions of the webbing in a more tortuous path between the resilient projecting member and the second transverse member to prevent movement of the webbing in either direction. As discussed above, the resilient projecting member is movable away from the second transverse member to ease adjustment of the webbing by decreasing friction on the webbing and decreasing the webbing release angle. In another embodiment, the resilient projecting member is disposed on its own support member extending from a lower portion of the body member. In another embodiment, the resilient projecting member is positioned so that the second transverse member 30 is disposed between the first transverse member 20 and the resilient projecting member. In this alternative embodiment, a front side portion of the resilient projecting member is biased toward a front side portion of the second transverse member located on what is identified as the back side portion 34 of the second transverse member in FIGS. 2 and 3. Likewise the backside portion of the second transverse member will be on the opposite side indicated in FIGS. 2 and 3. The embodiments of the apparatus disclosed herein engage and increase overall friction on the webbing to prevent slippage of the webbing in at least one direction even with little or no tension applied to the webbing W. The resilient projecting member eases adjustment of the webbing when the resilient projecting member is moved away from the second transverse member by reducing friction on the webbing and reducing the webbing release angle required to adjust the webbing.

Figure 4:
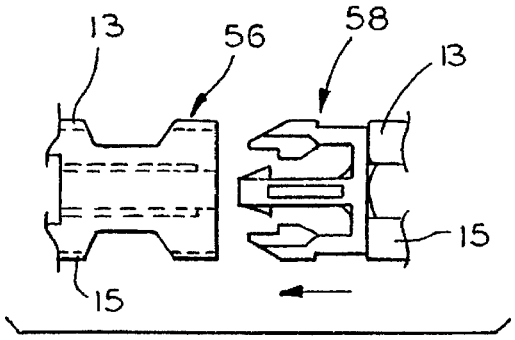
FIG. 4 is a partial perspective view of an alternative embodiment of the present invention including a buckle system with mating male and female portions.

The embodiment of FIG. 1 is a one piece buckle that includes a third transverse member 50 and a fourth transverse member 52 both interconnecting the opposing side portions 12 and 14 of the body member. FIG. 2 illustrates an end portion of webbing W, which may or may not be a part of the webbing retained by the resilient projecting member 40, looped about the third transverse member 50 and secured to itself by threading or other means known in the art. FIGS. 1 and 2 also illustrate that the buckle may have a contoured upper surface 16 to provide comfort and a low profile that prevents inadvertent snagging of the buckle. In addition, the opposing sides are dimensioned to prevent the webbing from protruding above and below the upper and lower sides 16 and 18 to further enhance the functional profile of the buckle. FIG. 4 is partial perspective view of a two part buckle with a female end 56 lockingly engageable with a male end 58 as known in the art. Each mating end 56 and 58 includes outer side portions 13 and 15 illustrated with broken lines. In an alternative embodiment, the first transverse member 20 with the resilient projecting member 40 biased toward the second transverse 30 of FIG. 1 may interconnect the opposing side portions 13 and 15 of one or both of the mating ends 56 and 58. For example, the embodiment of FIG. 4 may be interpositioned between the broken lines along the opposing sides 12 and 14 of FIG. 1 wherein outer side portions 13 are aligned and coupled with opposing sides 12 and outer side portions 15 are aligned and coupled with opposing sides 14 to form a two part buckle incorporating the features of the present invention. The embodiments of the present invention may be comprised of a plastic, metal or other materials formed by molding, casting and other means known in the art. The one piece buckle embodiment is preferably formed of a unitary plastic member, and the two part buckle embodiment is preferable formed of two separate unitary plastic members.

While the foregoing written description of the invention enables any one skilled in the art to make and use what is at present considered to be the best mode of the invention, it will be appreciated and understood by those skilled in the art the existence of variations, combinations, modifications and equivalents within the spirit and scope of the specific exemplary embodiments disclosed herein. The present invention therefore is to be limited not by the specific exemplary embodiments disclosed herein but by all of the embodiments within the scope of the appended claims.

What is claimed is:

1. Apparatus for webbing retention and adjustment, comprising:

a body member having oppositely disposed side members integrally interconnected by first and second transverse members, an upper side, and a lower side; and a resilient projecting member integral with said first transverse member, extending toward said second transverse member so as to be biased toward a first position at which said resilient projecting member is disposed adjacent to said second transverse member such that said resilient projecting member is engageable with a portion of webbing interposed between said resilient projecting member and said second transverse member so as to increase friction upon said webbing and prevent slippage of said webbing in opposite directions, and being flexibly movable, with respect to said first transverse member, to a second position at which said resilient projecting member is disposed away from said second transverse member so as to permit adjustment of said webbing interposed between said second transverse member and said resilient projecting member by reducing the amount of friction normally imposed upon said webbing between said second transverse member and said resilient projecting member when said resilient projecting member is disposed at said first position with respect to said second transverse member.

2. The apparatus according to claim 1, wherein:

a lower side portion of said first transverse member forms a webbing contact surface;

an upper side portion of said second transverse member forms a webbing contact surface; and said resilient projecting member projects upwardly from a lower side portion of said first transverse member such that a first engaging portion of said resilient projecting member, for engaging a first surface portion of said webbing, is disposed adjacent to a second engaging portion of said second transverse member, for engaging a second surface portion of said webbing, when said resilient projecting member is disposed at said first position adjacent to said second transverse member.

3. The apparatus as set forth in claim 2, wherein:

said resiliently projecting member extending upwardly from said first transverse member extends upwardly beyond said upper side of said body member so as to facilitate manual grasping of said resilient projecting member and thereby facilitate movement of said resilient projecting member from said first position to said second position.

4. The apparatus as set forth in claim 2, wherein:

said webbing contact surface of said second transverse member comprises a plurality of grooves for preventing lateral slippage of said webbing with respect to said webbing contact surface of said second transverse member.

5. The apparatus according to claim 2, wherein:

said first engaging portion of said resilient projecting member includes a first ledge portion having a lower surface; and said second engaging portion of said second transverse member includes a second ledge portion having an upper surface for cooperating with said lower surface of said first ledge portion of said resilient projecting member so as to frictionally engage said webbing when said resilient projecting member is biased toward said first position at which said resilient projecting member is disposed adjacent to said second transverse member so as to increase said friction on said webbing and prevent said slippage of said webbing in said opposite directions.

6. The apparatus according to claim 5, wherein:

said first ledge portion of said resilient projecting member is substantially complementary with said second ledge portion of said second transverse member, and said first ledge portion of said resilient projecting member, said second ledge portion of said second transverse member, said webbing contact surface of said first transverse member, and said webbing contact surface of said second transverse cooperate together so as to define a tortuous path for said webbing when said resilient projecting member is disposed at said first position and said webbing is interposed between said resilient projecting member and said second transverse member.

7. The apparatus according to claim 1, wherein:

said body member comprises a third transverse member interconnecting said oppositely disposed side members of said body member;

said second transverse member is disposed intermediate said first and third transverse members; and an end portion of a webbing is disposable about said third transverse member.

8. The apparatus according to claim 7 Wherein the apparatus is formed of a unitary plastic member.

9. The apparatus according to claim 1 wherein the apparatus is formed of a unitary member.

10. The apparatus according to claim 1 wherein the body member is part of a buckle system with mating male and female portions.

11.The apparatus as set forth in claim 1, wherein:

said resilient projecting member extends upwardly from said first transverse member so as to extend upwardly beyond said upper side of said body member so as to facilitate manual grasping of said resilient projecting member and thereby facilitate movement of said resilient projecting member from said first position to said second position.

12. A method for retaining a webbing and for permitting adjustment thereof, comprising the steps of:

providing a body member with oppositely disposed side members integrally interconnected by first and second transverse members;

disposing a webbing between said first transverse member and said second transverse member;

biasing a resilient projecting member, integral with said first transverse member and extending toward said second transverse member, toward a first position at which said resilient projecting member is disposed adjacent to said second transverse member for engaging a portion of said webbing interposed between said resilient projecting member and said second transverse member so as to increase friction upon said webbing and prevent slippage of said webbing in opposite directions; and flexing said resilient projecting member with respect to said first transverse member and away from said second transverse member to a second position at which said resilient projecting member is disposed away from said second transverse member so as to permit adjustment of said webbing interposed between said second transverse member and said resilient projecting member by reducing the amount of friction normally imposed upon said webbing between said second transverse member and said resilient projecting member when said resilient projecting member is disposed at said first position with respect to said second transverse member.

13. The method according to claim 12, further comprising the steps of:

providing a lower side portion of said first transverse member with a webbing contact surface;

providing an upper side portion of said second transverse member with a webbing contact surface;

providing said resilient projecting member with a first engaging portion for engaging a first surface portion of said webbing; and providing said second transverse member with a second engaging portion for engaging a second surface portion of said webbing.

14. The method as set forth in claim 13, further comprising the steps of:

providing said webbing contact surface of said second transverse member with a plurality of grooves for preventing lateral slippage of said webbing with respect to said webbing contact surface of said second transverse member.

15. The method according to claim 13, further comprising the steps of:

providing said first engaging portion of said resilient projecting member with a first ledge portion having a lower surface;

providing said second engaging portion of said second transverse member with a second ledge portion having an upper surface for cooperating with said lower surface of said first ledge portion of said resilient projecting member so as to frictionally engage said webbing when said resilient projecting is biased toward said first position at which said resilient projecting member is disposed adjacent to said second transverse member so as to increase said friction upon said webbing and prevent said slippage of said webbing in said opposite directions.

16. The method according to claim 15, further comprising the steps of:

providing said first ledge portion of said resilient projecting member with a configuration which is substantially complementary with a configuration provided for said second ledge portion of said second transverse member; and arranging said webbing contact surface of said first transverse member, said webbing contact surface of said second transverse member, said first ledge portion of said resilient projecting member, and said second ledge portion of said second transverse member with respect to each other such that webbing contact surfaces of said first and second transverse members, and said first and second ledge portions of said resilient projecting and second transverse members, cooperate together so as to define a tortuous path for said webbing when said resilient projecting member is disposed at said first position and said webbing is interposed between said resilient projecting member and said second transverse member.

17. The method as set forth in claim 12 further comprising the step of:

providing said body member with a third transverse member, interconnecting said oppositely disposed side members of said body member, such that said second transverse member is interposed between said first and third transverse members, wherein said third transverse member is adapted to mount an end portion of a webbing thereon.

18. The method as set forth in claim 17, further comprising the step of:

forming said body member, said first, second, and third transverse members, and said resilient projecting member as a unitary plastic member.

19. The method as set forth in claim 12, further comprising the step of:

forming said body member, said first and second transverse members, and said resilient projecting member as a unitary plastic member.

20. The method as set forth in claim 12, further comprising the steps of:

providing said body member with an upper surface; and forming said resilient projecting member such that said resilient projecting member extends upwardly from said first transverse member so as to extend upwardly beyond said upper surface of said body member so as to facilitate manual grasping of said resilient projecting member and thereby facilitate movement of said resilient projecting member from said first position to said second position.

* * * * *